US005923941A

United States Patent [19]

Harada et al.

[11] Patent Number: 5,923,941

[45] Date of Patent: Jul. 13, 1999

[54] DOCUMENT TRANSPORT DEVICE

[75] Inventors: Hiroyuki Harada; Toru Tanjo; Kazuhisa Kondo; Jun Kusakabe; Masahiro Sako; Hiroshi Kobayashi, all of Osaka, Japan

[73] Assignee: Mita Industrial Co., Ltd., Osaka-fu, Japan

[21] Appl. No.: 08/990,344

[22] Filed: Dec. 15, 1997

[30] Foreign Application Priority Data

Jan. 18, 1997 [JP] Japan ..... 9-019903

[51] Int. Cl.[6] ..... G03G 15/00

[52] U.S. Cl. ..... 399/367; 271/7; 399/373

[58] Field of Search ..... 399/367, 372, 399/373, 380; 358/498, 497; 271/7, 6, 4.09, 10.07, 10.1, 4.06

[56] References Cited

U.S. PATENT DOCUMENTS 4,954,847 9/1990 Murata et al. ..... 399/374
4,975,749 12/1990 Tsunoda et al. ..... 399/374
5,532,847 7/1996 Maruyama ..... 358/498
5,587,782 12/1996 Johdai et al. .
5,599,014 2/1997 Kitahara et al. ..... 271/270
5,680,203 10/1997 Kobayashi et al. ..... 355/76

*Primary Examiner*—Robert Beatty
*Attorney, Agent, or Firm*—Jordan and Hamburg LLP

[57] ABSTRACT

This invention relates to a document transport device for use in an image forming apparatus. The document transport device has a first belt roller disposed above a document positioning member. A second belt roller is disposed away from the first belt roller in the document transport direction. An endless belt is wound around the first and second belt rollers. Plural presser rollers are arranged on a specified position between the first and second belt rollers to press the belt against a contact glass. The document transport device has a tension roller between the first belt roller and the presser roller closest thereto to apply a tension force to the belt so as to set the belt at the lowermost position of the tension roller below a common tangential line to the circumferences of the first belt roller and the presser roller and apart from the contact glass.

10 Claims, 5 Drawing Sheets

DOCUMENT TRANSPORT DEVICE

BACKGROUND OF THE INVENTION

1. Field of the Invention

This invention relates to a document transport device for use in an image forming apparatus such as an electrostatic photography type copying machine and a facsimile machine.

2. Description of the Background Art

FIG. 1 is a partially cross sectional view of an image forming apparatus incorporated with a document transport device of prior art. As shown in FIG. 1, the conventional document transport device has a drive roller 32 above a document positioning member 35 that is arranged at an end portion of a contact glass 31 (leftmost end in FIG. 1) with respect to a document transport direction shown by the arrow X. The positioning member 35 is adapted for temporarily pausing feed of a document and positioning the document relative to the contact glass 31 at a certain position for image reading.

A driven roller (not shown) is arranged at the opposite end (rightward direction in FIG. 1) of the contact glass 31 in the document transport direction X. An endless document transport belt 33 is wound around the pair of drive roller 32 and the unillustrated driven roller.

The document transport device further comprises several presser rollers 34 between the drive and driven rollers to press the belt 33 against the upper surface of the contact glass 31 at several positions. Note that only one presser roller 34 closest to the drive roller 32 is shown in FIG. 1.

When the belt 33 is driven between the drive roller 32 and the driven roller, a certain portion (hereinafter referred to as "document guide portion" and shown by the broken line in FIG. 1) 33*a* of the belt 33 between the drive roller 32 and the presser roller 34 arranged closest thereto leaves away from the contact glass 31, thereby defining a document guide clearance C between the document guide portion 33*a* and the upper surface of the contact glass 31.

With this arrangement, a document is guided in the document guide clearance C via a document inlet port 36 defined between the positioning member 35 and the drive roller 32.

If a document has a curled portion at an end thereof, such document is guided in the document guide clearance C without correcting the curl. Accordingly, a shade or a black image corresponding to the curled portion of the document is formed on a copy sheet after an image formation because the curled portion does not properly make contact with the contact glass 31.

To prevent such drawback, generally, the document transport device has a sub roller 37 which is movable up and down on the contact glass 31 to be away from the contact glass 31 and in pressing contact therewith. The sub roller 37 is arranged near the positioning member 35 and is connected to a bias member (such as a spring) which applies a bias force to move the sub roller 37 downward toward the contact glass 31 to set the document guide portion 33*a* around the sub roller 37 in pressing contact with the contact glass 31. With this arrangement, the document guide portion 33*a* of the belt 33 between the drive roller 32 and the presser roller 34 is pressed against the contact glass 31 with an attempt to prevent a poor image formation due to a curl of an original document.

The above arrangement has suffered from the following drawback because it was aimed to reduce the document guide clearance C as much as possible by the downward movement of the sub roller 37 to prevent a poor image formation due to a curl of an original document. Specifically, when pressing the belt guide portion 33*a* against the contact glass 31, a frictional force caused between the belt guide portion 33*a* and the contact glass 31 increases. As a result, a load exerted to a belt drive motor (not shown) to drive the drive roller 32 to forward the belt 33 overcoming the frictional force becomes large, resulting in the necessity of providing a belt drive motor with a large torque force to reliably transport the document over the contact glass 31. The provision of belt drive motor having such large torque force raises the production cost of the document transport device, and cost rise of the image forming apparatus as a whole will result.

SUMMARY OF THE INVENTION

In view of the above drawbacks of the prior art, it is an object of this invention to provide a document transport device that realizes smooth document transport over a contact glass, while assuredly preventing a poor image formation due to a curl of an original document and suppressing cost rise of the document transport device.

It is another object of this invention to provide an image forming apparatus incorporated with such document transport device.

To accomplish the above objects, this invention is directed to a document transport device for transporting a document in a document transport direction onto the upper surface of a contact glass over a positioning member. The document transport device comprises: a first belt roller disposed above the positioning member; a second belt roller disposed away from the first belt roller in the document transport direction; a document transport belt wound around the first belt roller and the second belt roller over the contact glass; a first presser roller disposed between the first belt roller and the second belt roller for pressing the document transport belt against the contact glass; and a tension roller disposed between the first belt roller and the first presser roller for applying a tension force to the document transport belt to set the document transport belt at a lowermost position of the tension roller below a common tangential line to the circumferences of the first belt roller and the first presser roller and apart from the upper surface of the contact glass.

Further, this invention is directed to an image forming apparatus. The image forming apparatus comprises: a contact glass on which a document is placed; a positioning member for positioning the document placed on the contact glass; a document transporter for transporting the document in a document transport direction onto the upper surface of the contact glass over the positioning member; and an image reader for reading the image of the document placed on the contact glass. The document transporter includes: a first belt roller disposed above the positioning member; a second belt roller disposed away from the first belt roller by a certain distance in the document transport direction; a document transport belt wound around the first belt roller and the second belt roller over the contact glass; a first presser roller disposed between the first belt roller and the second belt roller for pressing the document transport belt against the contact glass; and a tension roller disposed between the first belt roller and the first presser roller for applying a tension force to the document transport belt to set the document transport belt at a lowermost position of the tension roller below a common tangential line to the circumferences of the first belt roller and the first presser roller and apart from the upper surface of the contact glass.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
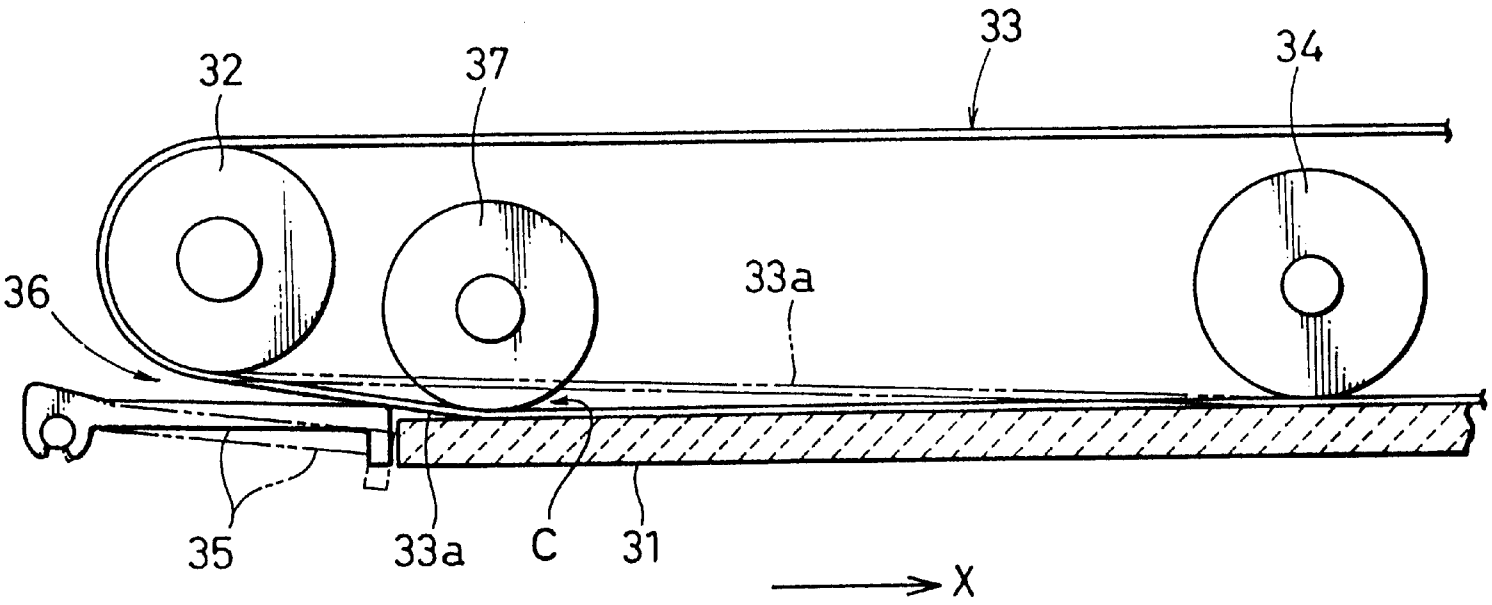
FIG. 1 (PRIOR ART)
FIG. 1 is a partially cross sectional view of an image forming apparatus incorporated with a document transport device of prior art.
Figure 2:
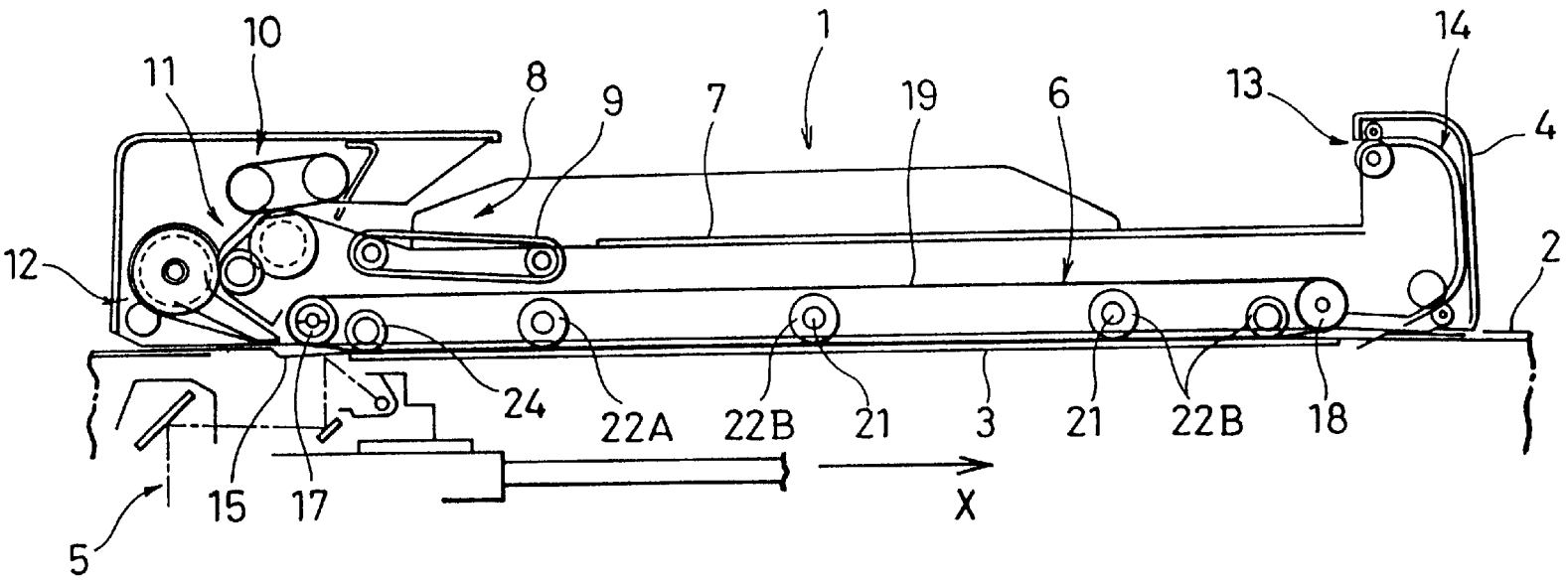
FIG. 2 is a partially cross sectional view of an image forming apparatus incorporated with a document transport device of this invention.

Hereinafter, a preferred embodiment of this invention is described with reference to the accompanying drawings. FIG. 2 is a partially sectional view of an electrostatic photography type copying machine exemplifying an image forming apparatus and incorporated with a document transport device according to this invention.

The copying machine comprises a main body 2, a contact glass 3 provided on the top of the main body 2 to set an original document thereon, a positioning member 15 which positions the document placed on the contact glass 3 relative thereto, and an image reader 5 which reads the image of the document. The copying machine further comprises a document feeder mechanism 1 with a function of turning over the side of the document to effect an automatic double-sided copying of the document.

The document feeder mechanism 1 has a casing member 4 with a principal plane sufficiently large enough to cover the surface plane of the contact glass 3. The casing member 4 is openably mounted on the machine main body 2 and is set to an open state by a pivotal movement thereof around a horizontal shaft on the rear side of the machine main body 2 in FIG. 2. The casing member 4 is internally arranged with a document transporter 6 (a document transport device of this invention) which transports an original document onto a specified position of the contact glass 3 for image reading.

The upper portion of the casing member 4 serves as a document setting tray 7. Near a document inlet port 8 of the casing member 4, there are arranged a document feeder 9 which feeds-in a set of documents stacked on the document setting tray 7 one by one from the lowermost one, and a document multifeed prevention member 10 which prevents a multiple feeding of documents.

The casing member 4 is further internally arranged with a document forwarder 11 which forwards the lowermost document separated from the rest of the document(s) by the multifeed prevention member 10 toward the document transporter 6 in the document transport direction X, and a document flip-over/refeeder (or simply referred to as "document FO/RF") 12 which feeds the document, once fed to the contact glass 3 for one side image reading, in the reverse direction opposite to the document transport direction X and feeds the document toward the document transporter 6 again after having flipped over the side for the opposite side image reading.

A document outlet port 13 is formed in the casing member 4 at the opposite side of the document inlet port 8 in such a manner as to define an enclosed portion between the document inlet port 8 and the document outlet port 13. The enclosed portion corresponds to the document setting tray 7 (or document discharge tray). The casing member 4 is further internally provided with a document discharge path 14 along which the document after one-sided or double-sided image reading is discharged onto the document discharge tray 7 through the document outlet port 13.

With the above arrangement, when one-sided image formation is to be effected for a set of documents, the set of documents are placed on the document setting tray 7 such that the principal plane carrying the original image on each document faces upward. In this state, when a selector switch for designating one-sided image formation is pressed and a copy start switch is activated, the documents stacked on the document setting tray 7 are successively fed to the document transporter 6 via the document forwarder 11 from the lowermost one.

Then, the image reader 5 is activated, and the original document image read by the image reader 5 is copied on one side of a copy sheet dispensed from a cassette (not shown) provided on the machine main body side. After the one-sided image formation is effected, the copy sheet with the side carrying the copied image facing upward is discharged onto a sheet discharge tray (not shown) provided on the side of the machine main body 2.

Meanwhile, the lowermost document after the image reading is discharged onto the document discharge tray 7 with the principal plane carrying the original image facing upward via the document discharge path 14 and the document outlet port 13. Concurrently, the next document, which in turn, becomes the lowermost document of the document set stacked on the document setting tray 7 is fed to the document transporter 6 in the same manner as described above.

In this way, the above one-sided image formation is cyclically repeated until all the documents set on the document setting tray 7 are discharged onto the document discharge tray 7 after having passed the document transporter 6.

On the other hand, when double-sided image formation is to be effected for a set of documents each carrying an original image on both sides (side A and side B) thereof, the set of documents are placed on the document setting tray 7 in the following manner.

Specifically, each of the documents is set such that e.g., the side A carrying the first image for copying faces upward. In this state, when a selector switch for designating double-sided image formation is pressed and the copy start switch is activated, the documents stacked on the document setting tray 7 are successively fed to the document transporter 6 via the document forwarder 11 from the lowermost one.

Subsequently, the lowermost document once fed to the document transporter 6 is fed in the reverse direction opposite to the document transport direction X, flips over or turns over the side thereof, and is fed to the document transporter 6 again by the document FO/RF 12. Further, the image reader 5 is activated in synchronism with the flip-over/refeed operation of the document FO/RF 12. In this way, the original image on the side B of the document is first copied on one side of a copy sheet.

Figure 4:
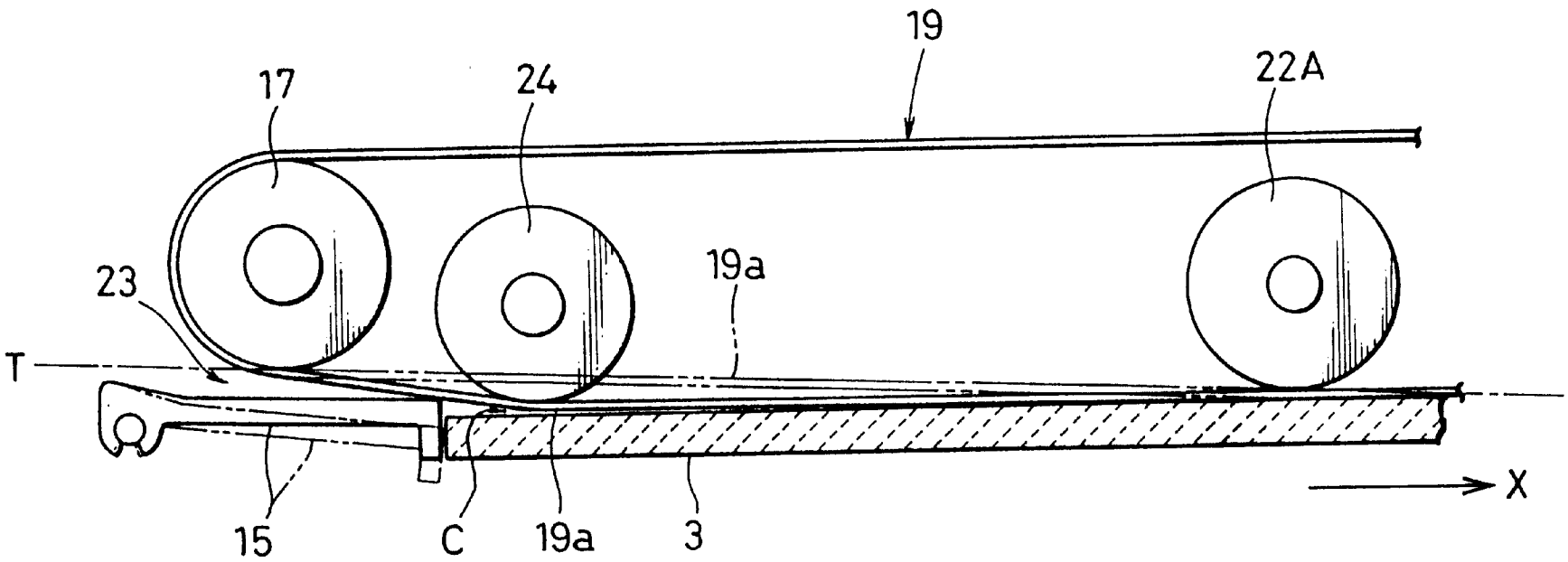
FIG. 4 is an enlarged cross sectional view of the document transporter on the side of a first belt roller.

It should be noted that the document positioning member 15 is constructed such that it can change its posture between the state shown by the solid line and the state shown by the broken line in FIG. 4. During the time when the document once fed to the document transporter 6 is being fed backward opposite to the document transport direction X and then forwarded to the document transporter 6 again by the document FO/RF 12, the positioning member 15 retracts to the position shown by the broken line in response to a command of flip-over/refeed operation by the document FO/RF 12 to prevent interference of the flip-over/refeed operation of the document.

Referring back to the copy sheet with the original image on the side B copied, the copy sheet flips over the side inside the machine main body 2 and is fed back again for image formation. Concurrently, the document after reading of the original image of the side B also turns over the side and is fed to the document transporter 6 again by the document FO/RF 12. In synchronism with the flip-over/refeed operation, the image reader 5 is activated to effect copying of the original image of the side A on the opposite side of the copy sheet. In this way, after having finished with the double-sided image formation, the copy sheet is discharged onto the sheet discharge tray with the side carrying the copied image of side A facing upward.

The lowermost document after both sides image reading is discharged onto the document discharge tray 7 with the side A facing upward via the document discharge path 14 and the document outlet port 13. Simultaneously, the next document, which in turn, becomes the lowermost document is fed to the document transporter 6 in the same manner as described above.

The above image reading is cyclically repeated until all the documents set on the document setting tray 7 are discharged onto the document discharge tray 7 after the image reading. In accordance with the successive image reading, copy sheets having been finished with the double-sided image formation are discharged onto the sheet discharge tray in the same order as the original documents stacked on the document discharge tray 7.

Next, the arrangement of the document transporter 6 (document transport device) is described in detail.

The document transporter 6 is disposed above the document positioning member 15, and comprises a drive roller (first belt roller) 17 driven by a drive mechanism 16, a driven roller (second belt roller) 18 disposed away from the first belt roller 17 by a certain distance in the document transport direction X. An endless document transport belt 19 is wound around the first and second belt rollers 17 and 18.

Figure 3:
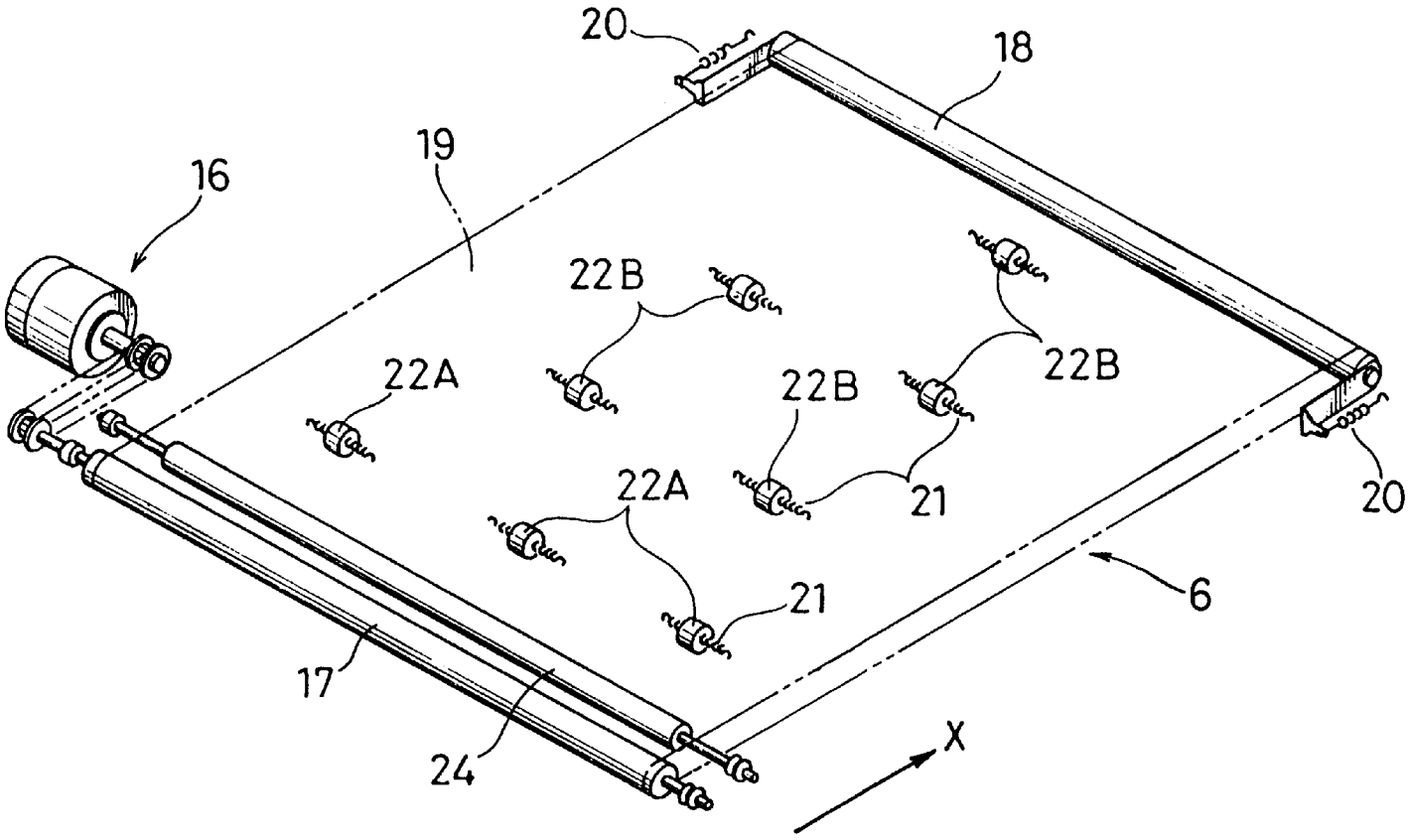
FIG. 3 is a perspective view of a document transporter without showing a document transport belt.

As shown in FIG. 3, tension suppliers 20, 20 which apply a tension force to the belt 19 between the first and second belt rollers 17, 18 are provided at the opposite axial ends of the driven roller 18, respectively in such a manner that one end of each tension supplier 20 is connected to a roller support 18*a* of the driven roller 18 and the opposite end is connected to the inside of the casing member 4.

Multiple presser rollers 22A and 22B are arranged between the first and second belt rollers 17 and 18, i.e., inside the space of the upper and lower portions of the belt 19 such that each presser roller is rotatably supported on the belt portion via a coil spring 21. The coil spring 21 functions as a support for each presser roller, and has its end thereof connected with a roller support member (not shown).

Among the presser rollers 22A and 22B, the group of the presser rollers indicated by 22A are arranged closest to the first belt roller 17, while the other group of presser rollers indicated by 22B are arranged apart from one another at their respective appropriate positions between the presser rollers 22A and the second belt roller 18. With the arrangement in which the presser rollers 22A and 22B are provided at their respective appropriate positions, the belt 19 is pressed against the contact glass 3.

As mentioned above, the first belt roller 17 is disposed away above the positioning member 15, and the presser rollers 22A apply a certain pressing force to the belt 19 against the contact glass 3. Accordingly, as shown in FIG. 4, there is defined a document guide clearance C between a document guide portion 19*a* of the belt 19 formed between the first belt roller 17 and the presser roller(s) 22A and the upper surface of the contact glass 3, and a document is guided to the document guide clearance C through a document inlet port 23.

There is arranged a tension roller 24 between the first belt roller 17 and the presser rollers 22A whose shaft ends are supported on the inside of the casing member 4. Before getting into the detailed explanation about geometric relations, several terms and points are defined with reference to FIG. 5 as follows:

Designated by L24 is a line extending vertically through a point Pc (a center of the tension roller 24). Designated by T is a common tangential line (of its lower one) to the circumferences of the first belt roller 32 and the first presser roller(s) 22A.

An intersecting point between the common tangential line T and the line L24 is designated by Pa; an intersecting point between the circumference of the tension roller 24 and the line L24 is designated by Pb indicating the lowermost position of the tension roller 24; an intersecting point between the lower surface of the belt 19 and the line L24 is designated by Pd; and an intersecting point between the contact glass 3 and the line L24 is designated by Pe.

The tension roller 24 is provided to apply a tension force to the document guide portion 19*a* of the belt 19 to set the point Pd—the document guide portion 19*a* of the belt 19 at the lowermost position of the tension roller 24—below the common tangential line T and slightly above the upper surface point Pe of the contact glass 3.

Figure 5:
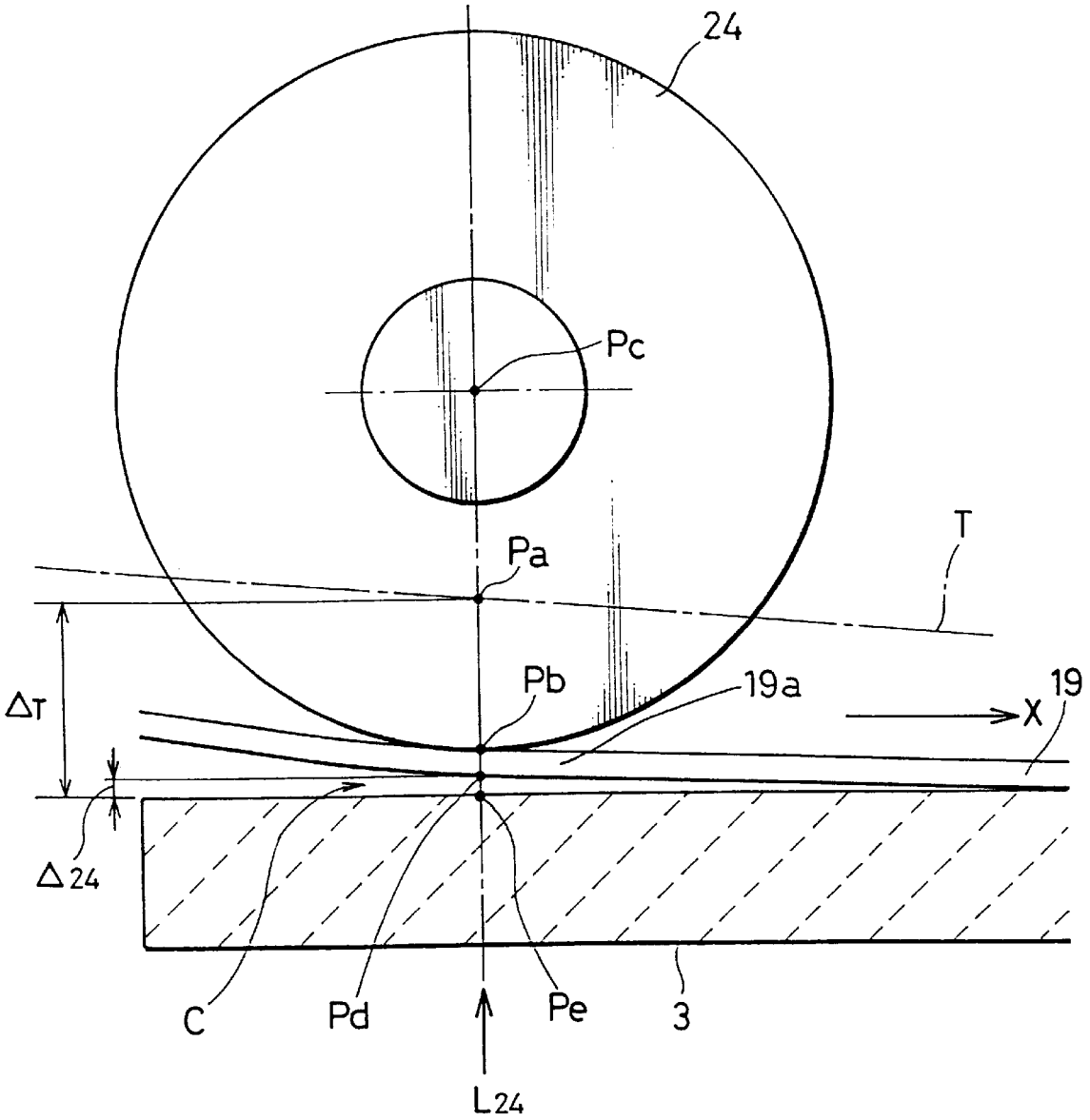
FIG. 5 is an enlarged cross sectional view in the vicinity of a tension roller.

More specifically, as clearly illustrated in FIG. 5, the distance Δ24 between the point Pd and the upper surface point Pe of the contact glass 3 is set smaller than the distance ΔT between the intersecting point Pa on the tangential line T and the upper surface point Pe of the contact glass 3. Thereby, since the document guide portion 19*a* of the belt 19 is set away from the contact glass 3 with an adequate clearance (approximately equal to Δ24 near the line L24), a document can be guided in the document guide clearance C while being applied with a sufficient pressing force from the document guide portion 19*a* via the tension roller 24 and also securing a clearance enough to pass the document therethrough.

In other words, providing the tension roller 24 in such a manner as to gradually reduce the space along the X-direction (rightward direction in FIG. 5) of the document guide clearance C without narrowing the space of the document inlet port 23 realizes a small clearance (i.e., non-contact state) between the document guide portion 19*a* and the contact glass 3.

With the document transporter 6 having the above arrangement, a document is smoothly guided between the document transport belt 19 and the contact glass 3 via the document inlet port 23.

The document guide clearance C in the document transport direction X is reduced in a way described above by the tension roller 24; therefore, even if a document guided in the document guide clearance C has a curled portion at one end thereof, such curl is adequately corrected when the document is passing through the small clearance C in the X direction, thereby effectively preventing formation of a shade corresponding to the curled portion of the document.

Furthermore, the point Pd of the document guide portion 19*a* is set away from the upper surface of the contact glass 3 by the distance Δ24. With this arrangement, a frictional force between the tension roller 24 and the contact glass 3 is reduced, thereby reducing a load exerted to the drive mechanism 16 which drives the belt 19 (i.e., transport a document) in the forward direction. Thereby, a drive mechanism having a smaller torque compared to the conventional document transport device can be adopted, which realizes production of an image forming apparatus with reduced cost.

Moreover, the above small clearance C can be obtained simply by fixedly arranging the tension roller 24 to a certain vertical position inside the casing member 4. Accordingly, compared to the conventional arrangement in which the sub roller 37 is set movable up and down with respect to the contact glass 3 and is pressed against the contact glass 3 utilizing the bias force of the bias member, the arrangement becomes simplified and the document transporter 6 can be assembled with reduced cost.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A document transport device for transporting a document in a document transport direction onto the upper surface of a contact glass over a positioning member, comprising:

a casing structure;

a first belt roller disposed on said structure above the positioning member;

a second belt roller disposed on said structure and spaced from the first belt roller in the document transport direction;

a document transport belt wound around the first belt roller and the second belt roller over the contact glass;

a first presser roller resiliently disposed on said structure between the first belt roller and the second belt roller for pressing the document transport belt against the contact glass; and a tension roller disposed in a fixed position on said structure between the first belt roller and the first presser roller for applying a tension force to the document transport belt to set the document transport belt at a lowermost position of the tension roller below a common tangential line extending tangentially between the circumference of the first belt roller and the circumference of the first presser roller and spaced from the upper surface of the contact glass.

2. The document transport device according to claim 1, wherein a distance between the document transport belt at the lowermost position of the tension roller and the contact glass is set smaller than a distance between the common tangential line at the lowermost position of the tension roller and the contact glass.

3. The document transport device according to claim 1, further comprising a second presser roller disposed between the first presser roller and the second belt roller for pressing the document transport belt against the contact glass.

4. An image forming apparatus comprising:

a body structure on which a casing is disposed;

a contact glass disposed on said body structure and on which a document is placed;

a positioning member disposed on said body structure for positioning the document placed on the contact glass;

a document transporter on said casing for transporting the document in a document transport direction onto the upper surface of the contact glass over the positioning member; and an image reader disposed on said body structure for reading the image of the document placed on the contact glass;

the document transporter including:

a first belt roller disposed on said casing above the positioning member;

a second belt roller disposed on said casing and spaced from the first belt roller in the document transport direction;

a document transport belt wound around the first belt roller and the second belt roller over the contact glass;

a first presser roller resiliently disposed between the first belt roller and the second belt roller for pressing the document transport belt against the contact glass; and a tension roller disposed in a fixed position on said casing between the first belt roller and the first presser roller for applying a tension force to the document transport belt to set the document transport belt at a lowermost position of the tension roller below a common tangential line extending tangentially between the circumference of the first belt roller and the circumferences of the first presser roller and spaced from the upper surface of the contact glass.

5. The image forming apparatus according to claim 4, wherein a distance between the document transport belt at the lowermost position of the tension roller and the contact glass is set smaller than a distance between the common tangential line at the lowermost position of the tension roller and the contact glass.

6. The image forming apparatus according to claim 4, further comprising a second presser roller disposed between the first presser roller and the second belt roller for pressing the document transport belt against the contact glass.

7. An image forming apparatus comprising:

a body structure on which a casing is disposed;

a contact glass disposed on said body structure and on which a document is placed;

a positioning member disposed on said body structure for positioning the document placed on the contact glass;

a document transporter on said casing for transporting the document in a document transport direction onto the upper surface of the contact glass over the positioning member; and an image reader disposed on said body structure for reading the image of the document placed on the contact glass;

the document transporter including:

a first belt roller disposable in a fixed position on said casing above the positioning member such that an inlet port is formed between said first belt roller and said positioning member, the spacing between said first belt roller and the positioning member defining the height of said inlet port;

a second belt roller on said casing and spaced from the first belt roller in the document transport direction;

a document transport belt wound around the first belt roller and the second belt roller;

a plurality of presser rollers resiliently mounted on said casing between said first and second belt rollers, said plurality of presser rollers including a first presser roller closer to said first belt roller than any of the other presser rollers;

a tension roller disposable in a fixed position on said casing between the first belt roller and the first presser roller for defining a sloped path for the portion of the belt between said first belt roller and the lowermost position of the tension roller, the spacing of the tension roller from said first belt roller in the direction of the document transport direction determining the degree of slope of said sloped path of said portion of said belt;

a desired height of said inlet port being obtained by selecting the fixed mounted position of said first belt roller above said positioning member and a desired degree of slope of said sloped path portion of said belt being obtained by selecting the fixed mounted position of said tension roller relative to the first belt roller in the document transport direction;

said tension roller being disposed in a fixed position on said casing spaced above said glass to dispose the belt at the lowermost position of the tension roller below a common tangential line extending tangentially between the circumference of the first belt roller and the circumference of the first presser roller; and said tension roller further being disposed in a fixed position on said casing spaced from the upper surface of the contact glass.

8. An image forming apparatus according to claim 7 including a biasing device biasing said second belt roller in a direction away from said first belt roller.

9. An image forming apparatus according to claim 7 including biasing devices biasing said plurality of pressed rollers toward said contact glass.

10. A document transporter for use with an image forming apparatus in which the image forming apparatus includes a body structure along with a contact glass on the body structure and a positioning member on said body structure for positioning the document placed on the contact glass, the document transporter comprising:

a casing:

a first belt roller disposable in a fixed position on said casing above the positioning member such that an inlet port is formed between said first belt roller and said positioning member, the spacing between said first belt roller and the positioning member defining the height of said inlet port;

a second belt roller on said casing and spaced from the first belt roller in the document transport direction;

a document transport belt wound around the first belt roller and the second belt roller;

a plurality of presser rollers resiliently mounted on said casing between said first and second belt rollers, said plurality of presser rollers including a first presser roller closer to said first belt roller than any of the other presser rollers;

a tension roller disposable in a fixed position on said casing between the first belt roller and the first presser roller for defining a sloped path for the portion of the belt between said first belt roller and the lowermost position of the tension roller, the spacing of the tension roller from said first belt roller in the direction of the document transport direction determining the degree of slope of said sloped path of said portion of said belt;

a desired height of said inlet port being obtained by selecting the fixed mounted position of said first belt roller above said positioning member and a desired degree of slope of said sloped path portion of said belt being obtained by selecting the fixed mounted position of said tension roller relative to the first belt roller in the document transport direction;

said tension roller being disposed in a fixed position on said casing spaced above said glass to dispose the belt at the lowermost position of the tension roller below a common tangential line extending tangentially between the circumference of the first belt roller and the circumference of the first presser roller; and said tension roller further being disposed in a fixed position on said casing spaced from the upper surface of the contact glass.

* * * * *